United States Patent [19]

Webb et al.

[11] Patent Number: 5,025,760

[45] Date of Patent: Jun. 25, 1991

[54] DIE-CAST LIQUID COOLED CYLINDER AND METHOD OF MAKING

[75] Inventors: Edward H. Webb, Paynesville, Minn.; Marley Duclo, Hotchkiss, Colo.

[73] Assignee: Koronis Parts, Inc., Paynesville, Minn.

[21] Appl. No.: 364,009

[22] Filed: Jun. 9, 1989

[51] Int. Cl.[5] ..... F02B 33/00

[52] U.S. Cl. ..... 123/73 PP; 123/65 A

[58] Field of Search ..... 123/73 PP, 65 A, 65 VC, 123/65 E, 65 P

[56] References Cited

U.S. PATENT DOCUMENTS

| | | | |
|---|---|---|---|
| 4,306,522 | 12/1981 | Fotsch | 123/73 PP |
| 4,373,475 | 2/1983 | Kirk | 123/73 PP |
| 4,549,507 | 10/1985 | Baumhardt | 123/73 PP |
| 4,598,673 | 7/1986 | Poehlman | 123/73 PP |
| 4,736,716 | 4/1988 | Ohyama | 123/65 A |
| 4,802,447 | 2/1989 | Corbett | 123/73 PP |
| 4,809,648 | 3/1989 | Luo | 123/73 PP |

*Primary Examiner*—Andrew M. Dolinar
*Assistant Examiner*—M. Macy
*Attorney, Agent, or Firm*—Merchant, Gould, Smith, Edell, Welter & Schmidt

[57] ABSTRACT

A unique method of manufacturing a liquid cooled cylinder block by means of a die-casting process is disclosed. The cylinder block (12) has a bore (15) with a plurality of apertures. There is an intake passage (24) through the cylinder block (12) which terminates in an intake port (25) in the bore (15), and an exhaust passage (29) that extends from an exhaust port (31). There are also a plurality of scavenge passages (27) which terminate in scavenge ports (28). The scavenge passages (27) interconnect the bore (15) and the combustion chamber (18). The scavenge passages (27) are formed by means of a pair of side covers (37) which are attached to the cylinder block (12) by means of a plurality of fasteners and a gasket (43). Suitable coolant enters via coolant passageway (44) and circulates through coolant passageways (33, 38, 50, 60).

3 Claims, 3 Drawing Sheets

FIG. 1
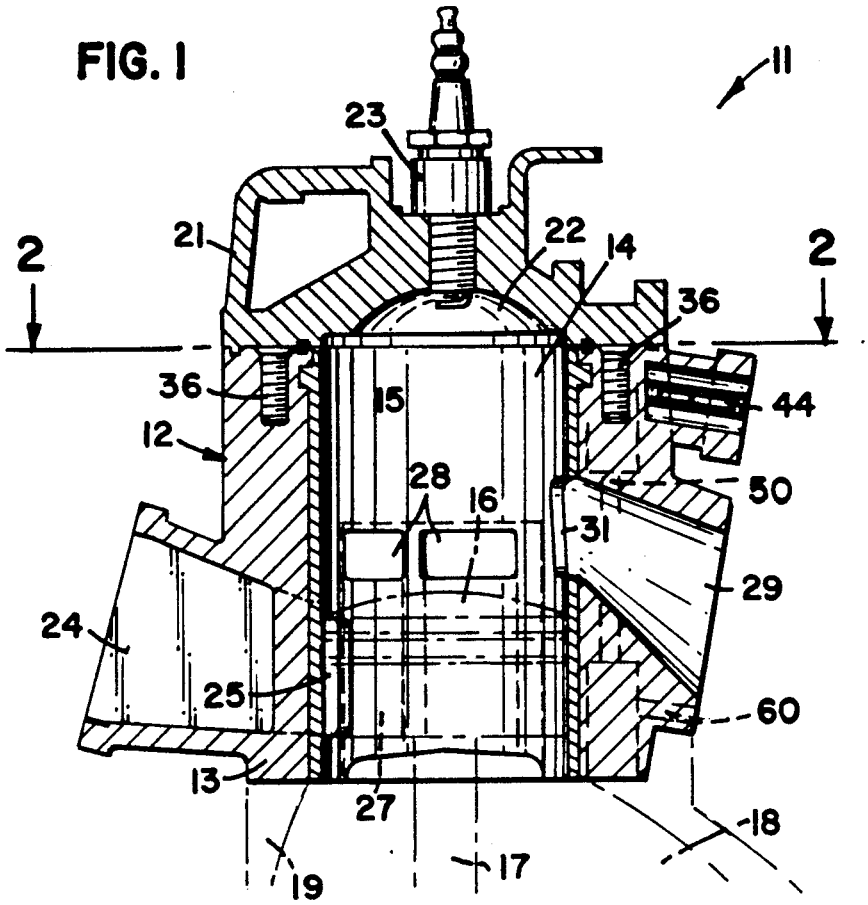
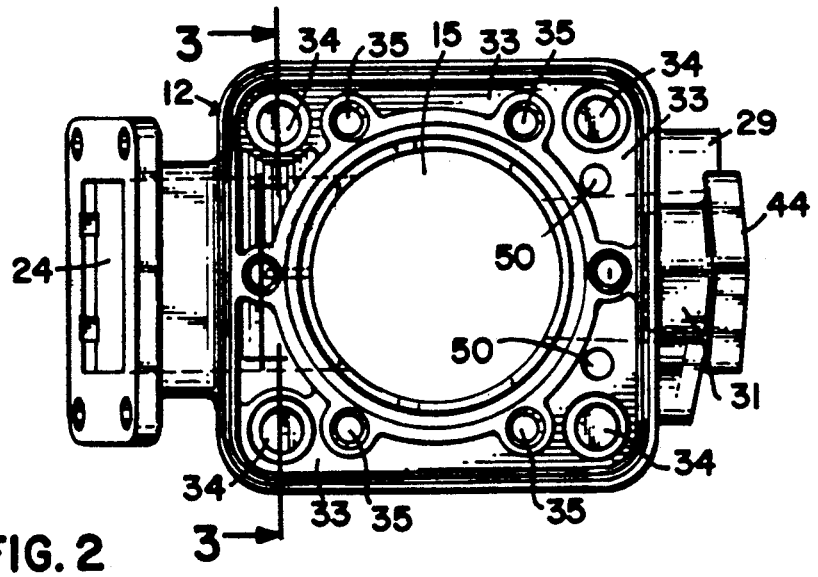
FIG. 2

FIG. 3
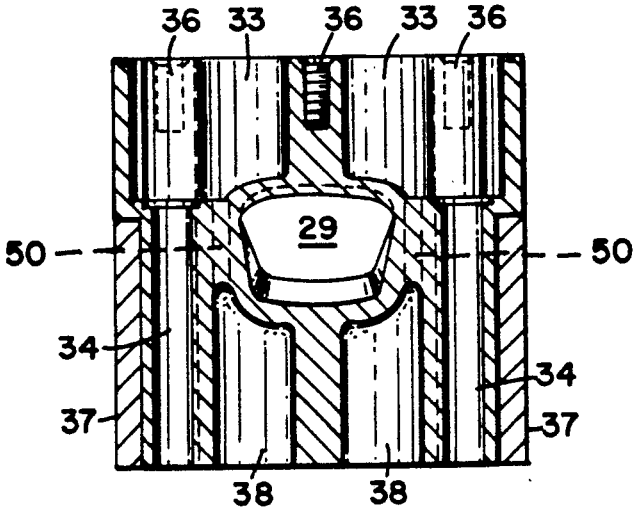
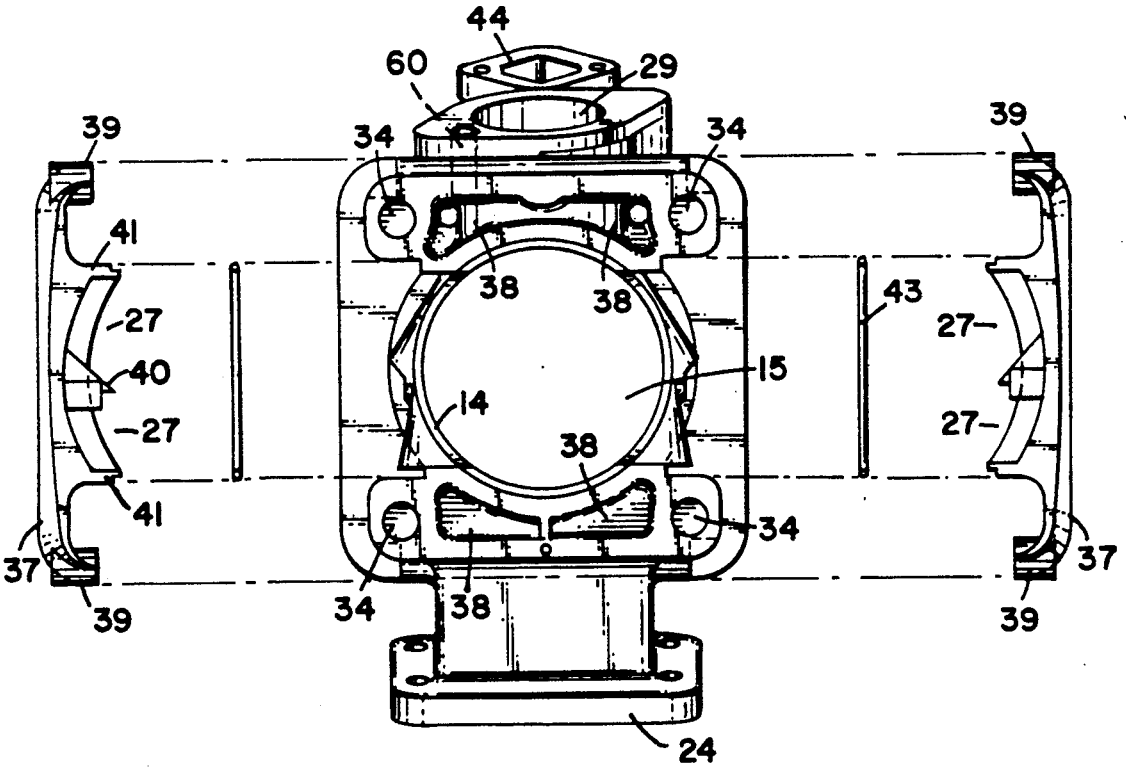
FIG. 4

FIG. 5
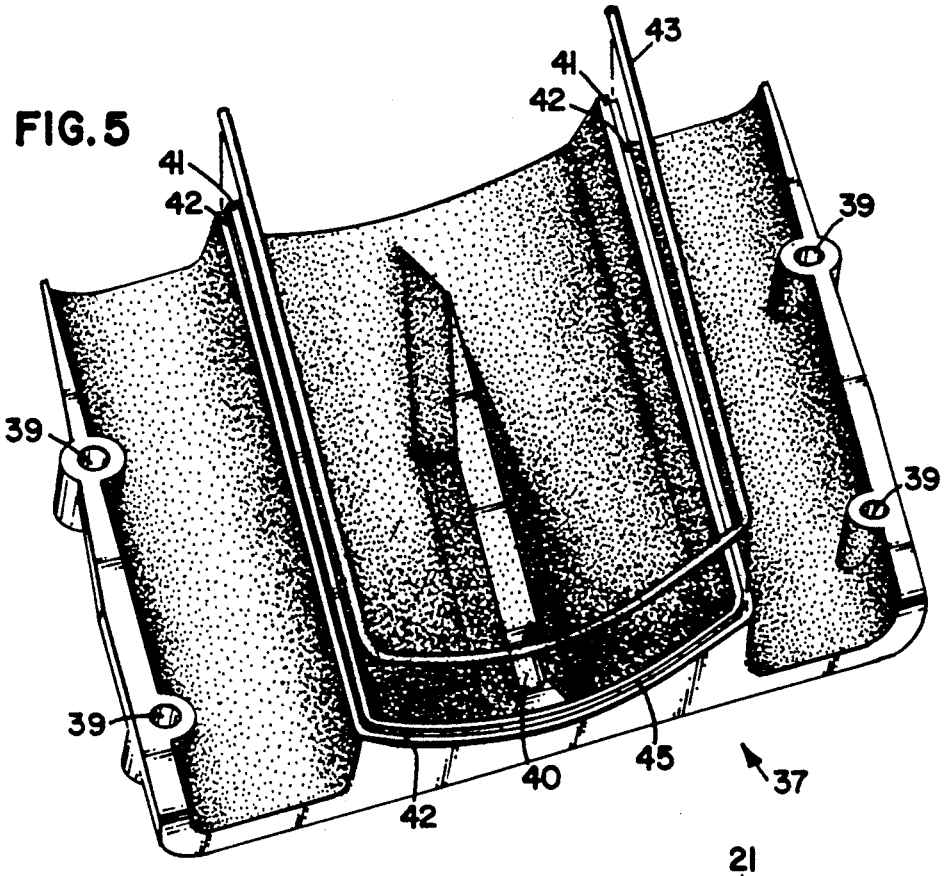
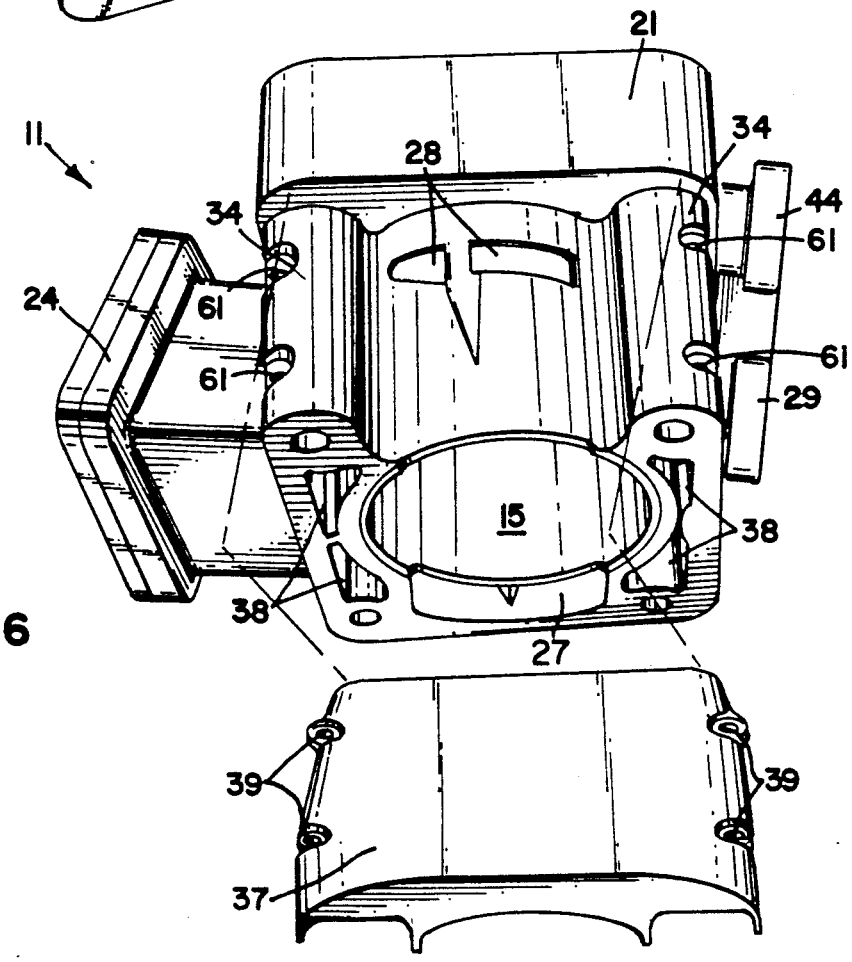
FIG. 6

DIE-CAST LIQUID COOLED CYLINDER AND METHOD OF MAKING

FIELD OF THE INVENTION

This invention relates to a cylinder block for an engine and more particularly to an improved method for manufacturing a liquid cooled cylinder block.

BACKGROUND OF THE INVENTION

The conventional method of producing a liquid cooled cylinder block is to sand-cast it, either with temporary tooling or with a permanent mold. With these methods, the mold is made by packing or ramming molding sand around a pattern. The mold is usually made in two parts so that the pattern can then be withdrawn. When the pattern is withdrawn, the imprint of the pattern provides the cavity which ultimately is filled with metal to form the casting. If the casting is to be hollow, then additional patterns, typically called cores, must be placed in the mold cavity to form the interior surfaces of the casting. Thus, the void between the mold and the core eventually becomes the casting. A molten metal of the proper composition and temperature is poured into the mold with gravity usually being employed to cause the metal to flow into the mold. After removing the casting, any adhering sand, scale or other foreign material is removed. Machining is typically necessary to correct other defects in the casting.

When the temporary tooling method is utilized, a new pattern must be made every time a cast cylinder is made. The pattern is usually made from wood when a small quantity of castings need to be made; but for larger quantities, aluminum, magnesium or certain hard plastics are employed.

With the permanent mold sand-casting method, a more expensive, permanent pattern is used, which produces a casting having improved dimensional accuracy. However, this method still does not maintain tolerances as close or sections as thin as are possible with the die-casting method.

The above conventional manufacturing methods are extremely labor-intensive and expensive. The packing of the sand, the withdrawal of the pattern, and the pouring of the metal are all done by hand. In addition, the machining necessary to clean up the parts after production of the casting requires additional labor and expense.

Another common manufacturing method used in various applications is die-casting. The dies usually consist of two blocks of steel, each containing a part of the cavity, which are locked together while the casting is being made and drawn apart when it is ready for ejection. Retractable and removable metal cores are used to form internal surfaces. Inserts can be cast into the piece by placing them on locating pins in the die. Die-casting differs from ordinary permanent-mold casting in that the molten metal is forced into the molds by pressure and held under pressure during solidification. The die-casting cycle consists of the following steps: 1) closing and locking the dies; 2) forcing the metal into the die and maintaining the pressure; 3) permitting the metal to solidify; 4) opening the die; and 5) ejecting the casting.

There are several advantages to the die-casting process. All-metal mold, external-pressure castings have close tolerances, sharp outlines and contours, fine smooth surfaces, and a high rate of production accompanied by low labor cost. Fine sections and excellent detail can be achieved, together with long mold life.

However, in the past it has not been possible to die-cast liquid cooled cylinder blocks, because the molten metal would enter the ports of the cylinder block and fill up the inside of the cylinder. One solution to this problem is the use of metal cores, which are used extensively in die-castings. However, provision must be made for retracting the metal cores, usually before the die is opened for removal of the casting. It is very important that the direction of the core-retracting motions be either a straight line or a circular arc. The configuration of a typical cylinder block's ports is such that the cores are unable to be retracted. With the sizing and configuration of the cylinder, it was impossible to utilize core pins to prevent metal from entering the inside of the cylinder, because there was no means of removing the core pins. Consequently, liquid cooled cylinder blocks have not been manufactured with the die-casting method in the past.

The present invention addresses these and many other problems associated with the currently available manufacturing methods for liquid cooled cylinder blocks.

SUMMARY OF THE INVENTION

The present invention comprises a die-cast liquid cooled cylinder. The cylinder has a cylindrical bore, which includes an intake port, an outtake port and a plurality of scavenge ports. Surrounding the bore member is a cylinder block which has a plurality of coolant passages. In addition, there are a pair of side covers on opposite sides of the cylinder block which form cavities or passageways interconnecting the scavenge port in the bore member and the engine's combustion chamber. According to another aspect of the invention, a method of making a liquid cooled cylinder is disclosed, including the steps of inserting a plurality of core pins in the apertures of the bore member; injecting molten metal under pressure into the mold; withdrawing the cylinder block casting from the mold; and attaching the side covers to the cylinder block casting.

A particular advantage of the present invention is that a liquid cooled cylinder can be produced at a greatly reduced part cost, and with greatly reduced labor. The labor involved with the method of the present invention is minimal, especially compared to the labor-intensive, prior art sand-casting methods.

Another advantage of the present invention is the dimensional accuracy of the die-casting process. This eliminates the need for substantial cleaning and machining of the part after it has been die-cast and produces an improved surface finish. In addition, the improved dimensional accuracy allows for closer dimensional tolerances to be achieved.

Another feature of the present invention is the streamlined design of the ports and coolant passages on the cylinder block. The smooth, curved shape of these portions of the cylinder block allow for optimal efficient operation of the engine.

For a better understanding of the invention, and of the advantages obtained by its use, reference should be made to the drawing and accompanying descriptive matter in which there is illustrated and described a preferred embodiment of the present invention.

BRIEF DESCRIPTION OF THE DRAWINGS

FIG. 1 is a cross-sectional view taken through a single cylinder of a two-cycle internal combustion engine having a cylinder block constructed in accordance with the present invention;

FIG. 2 is an end view of the cylinder shown in FIG. 1, taken at line 2—2 of FIG. 1;

FIG. 3 is a cross-sectional view of the cylinder shown in FIGS. 1 and 2, as viewed 90° from the view shown in FIG. 1 and taken at line 3—3 of FIG. 2;

FIG. 4 is a bottom, exploded view of the cylinder shown in FIGS. 1-3;

FIG. 5 is a perspective view of the side cover utilized with the present invention; and FIG. 6 is an exploded, perspective view of the cylinder block of the present invention.

DETAILED DESCRIPTION OF THE PREFERRED EMBODIMENT

Referring first to FIG. 1, a single cylinder of a two-cycle, reciprocating type, internal combustion engine is shown in cross-section and is identified generally by the reference numeral 11. Although the view is of only a single cylinder, it should be readily understood that the invention may be used with multi-cylinder engines of either the inline or V types. In the preferred embodiment, the cylinder 11 of the present invention is made of aluminum. The cylinder block assembly 12 consists of a main body portion 13, which may be formed from any suitable lightweight material such as aluminum, magnesium or a suitable alloy. There is a cylinder liner 14 which is formed of a dissimilar material, cast iron in the preferred embodiment of the invention. The cylinder liner or sleeve 14 is formed within a cylinder bore 15 in which a piston 16 is supported for reciprocation in the known manner. Alternatively, the cylinder block assembly 12 could be provided with no liner 14, but the surface of the bore member 15 could be chromed with a layer of suitable metal according to well-known methods.

The piston 16 is connected by means of a connecting rod 17 to a crankshaft (not shown) that is rotatably journaled within a crankcase 18 formed by a crankcase casting 19. A cylinder head 21 is affixed in a suitable manner to the cylinder block 12 and has a cavity 22 that is positioned above the cylinder bore 15 and with which the cylinder bore 15 and piston 16 form a chamber of varying volume which may be referred to at times as the combustion chamber. A spark plug 23 is supported in the cylinder head 21 and has its electrodes extending into the recess 22.

As is well known in two-cycle engine practice, a fuel/air mixture is drawn into the crankcase chamber 18 from an intake passage 24 that extends through the cylinder block 12. The passage 24 terminates in a first intake port 25 that is adapted, at times, to communicate with the area below the piston 16 so that the fuel/air charge may enter the crankcase chamber 18.

As is known with this type of engine, downward movement of the piston 16 causes compression of the fuel/air charge in the crankcase chamber 18, and the compressed charge is transferred through scavenge passages or cavities 27. The scavenge passages 27 are defined by the outside surface of the bore member 14 and the inside surface of the transfer covers 37, as described below. One end of the cavities 27 terminates in scavenge ports 28 that extend through the liner 14 to the combustion chamber 22. Preferably, there are a total of four scavenge ports 28; however, it is to be understood that a different number of scavenge ports 28 could be provided. The opposite end of the passages 27 extends into the combustion chamber. This fuel/air charge is fired by the spark plug 23 and is exhausted through one or more exhaust passages 29 that extend from the exhaust ports 31 formed in the liner 14 for discharge to the atmosphere in a suitable manner. The scavenge ports 28 are preferably rectangular in shape, but could be any shape, such as round or square. The edges of the ports 28 have a smooth, contoured surface so as to facilitate the efficient movement of the gases therethrough.

On the top of the cylinder head 21 are a plurality of holes 35 (see FIG. 2) for attachment of the cylinder head 21 and the cylinder block assembly 12. In the preferred embodiment, there are a total of six holes 35 around the circumference of the bore 15. Screws 36, shown in FIGS. 1 and 3, are inserted into the holes 35. As shown in FIGS. 3 and 4, there are also four holes 34 to accommodate bolts (not shown) which attach the bottom end of the cylinder assembly 12 onto the crankcase 18.

On one side of the cylinder assembly 12 is a coolant inlet passageway 44. The coolant inlet 44 is in fluid communication with a coolant reservoir 33 which surrounds the upper portion of the bore 15 on all sides. The water or other coolant enters through inlet 44 and passes through the upper and lower recesses 33 and 38 and around the bore 15 on all sides. In this manner, the coolant draws excess heat away from the engine 11. There are also two coolant passages 50, one on each side of the exhaust passage 29, which terminate in a cavity below the exhaust passage 29. As the coolant passes through the passages 50, excess heat is drawn away from the exhaust area of the engine assembly. One or more coolant exit passages 60 are in fluid communication with the coolant passages 50. After passing through the coolant recess 33 and passageways 50, the coolant exits the cylinder assembly 12 via the exit passages 60 and goes to the exhaust manifold. This coolant passageway design provides for effective removal of excess heat, thereby maximizing the efficiency and long life of the engine 11.

Two side covers or transfer covers 37 are utilized to form the scavenge passageways 27. Thus, the cylinder is formed from three pieces: the main body and the two side covers 37. The inner surface of the side covers, as shown in FIG. 5, has a contoured, central fin 40 and two side fins 41. The hollowed-out space between the fins 40, 41 forms the scavenge passageways 27. A plurality of screw holes 39 on the outer edges of the side covers 37 allow for attachment of the side covers 37 to the cylinder-block assembly 12 by suitable fasteners (not shown). As illustrated, the shape of the passages 27 and scavenge ports 28 is contoured and streamlined. This feature allows for maximum fluid flow therethrough, thereby greatly improving the efficiency of the engine 11.

Each side cover or transfer cover 37 is provided with a suitable sealing means which provides a seal between the cylinder's main body and the side covers 37. In the preferred embodiment, the sealing means is a gasket 43 of elastomeric material, such as rubber. The gasket 43 provides a seal between the side covers 37 and the cylinder block 12. By tightening the fasteners in the apertures 39, the gasket 43 is compressed. The gasket follows the outline of the fins 41 and intermediate fin 45, so as to be substantially U-shaped. Other suitable types of sealing means, such as epoxy, may be used instead of the rubber gaskets 43.

According to the method of the present invention, the sleeve or liner 14 is slipped into the mold, assuming that a liner 14 is utilized, as discussed above. As noted above, the surface of the bore 15 has a plurality of apertures, including an intake port 25, an outtake port 31, and a plurality of scavenge ports 28. In order to form these apertures and passageways which connect thereto, a plurality of core pins are inserted into the apertures. The core pins are preferably part of the mold and operate on a slide arrangement (not shown) so as to be inserted within the apertures in the sleeve 14 as the mold closes mechanically. If desired, the mold may be coated to facilitate withdrawal of the casting. The mold closes mechanically, and the press injects molten aluminum under pressure into the mold. The metal is held under pressure during the solidification process. The press then opens, which opens the mold. The core pins are mechanically retracted and the part is then taken out of the mold. If necessary, cleaning and machining procedures then take place. In the preferred embodiment, a molding machine is utilized which automatically coats the mold, pours the metal, and removes the casting. The core pins are mechanically retracted by means of ejector pins. Most castings then require some conventional cleaning and finishing operations.

The side covers 37 are installed after the casting has been made. The side covers 37 are also preferably die-cast. The side covers 37 are installed by positioning them against the cylinder-block assembly 12 and attaching the fasteners through the apertures 39.

With the prior art manufacturing methods, the core pins could be inserted through the bore 15, but because of the radiuses of the scavenge ports 28, there was no way to get out the core pins without ruining the cylinders. By utilizing the side covers 37, the core pins can enter the scavenge ports 28 so as to close off the area around the port 28, so that the injected aluminum does not fill up the inside of the cylinder. The transfer covers 37 are then attached to the cylinder block in a simple assembly step.

It is to be understood that numerous and various modifications can be readily devised in accordance with the principles of the present invention by those skilled in the art without departing from the spirit and scope of the invention. Therefore, it is not desired to restrict the invention to the particular constructions illustrated and described but to cover all modifications that may fall within the scope of the appended claims.

What is claimed is:

1. A die-cast liquid cooled cylinder, in an engine having a combustion chamber, comprising:

(a) a cylindrical bore member, said bore member including an intake port, an outtake port and a scavenge port;

(b) a cylinder block surrounding said bore member, said cylinder block including a plurality of coolant passages;

(c) a side cover connected to said cylinder block so as to form a cavity having two ends, a first end being proximate said scavenge port and a second end being in fluid communication with said combustion chamber, wherein an inside surface of said side cover has a contoured central fin and a pair of contoured side fins.

2. A die-cast liquid cooled cylinder in an engine, having a combustion chamber, comprising:

(a) a cylindrical liner, said liner including an intake port, an outtake port and a plurality of scavenge ports, said scavenge ports having edges with a smooth, contoured surface;

(b) a cylinder block surrounding said liner, said liner including a plurality of coolant passages; and (c) a pair of side covers connected to said cylinder block, each side cover forming two cavities, each cavity having two ends, a first end terminating in said scavenge port and a second end being in fluid communication with said combustion chamber, wherein said cavities are defined by a contoured central fin and a pair of contoured side fins on an inside surface of said side cover.

3. The cylinder according to claim 2, wherein said side cover is made by a die-casting process.

* * * * *